US007882795B1

(12) United States Patent
Snyder

(10) Patent No.: US 7,882,795 B1
(45) Date of Patent: Feb. 8, 2011

(54) ADJUSTABLE FISHERMAN SEAT ASSEMBLY AND ASSOCIATED METHOD

(76) Inventor: Carl Snyder, 3855 Blair Mill Rd., Unit 231 H, Horsham, PA (US) 19044

( * ) Notice: Subject to any disclaimer, the term of this patent is extended or adjusted under 35 U.S.C. 154(b) by 0 days.

(21) Appl. No.: 11/784,542

(22) Filed: Apr. 6, 2007

Related U.S. Application Data

(60) Provisional application No. 60/789,942, filed on Apr. 7, 2006.

(51) Int. Cl.
*B63B 17/00* (2006.01)

(52) U.S. Cl. ..... 114/363; 248/415; 248/425

(58) Field of Classification Search ..... 114/343, 114/363; 248/415, 418, 425; 297/252, 344.1; 440/102, 104, 105, 106
See application file for complete search history.

(56) References Cited

U.S. PATENT DOCUMENTS 1,058,855 A * 4/1913 Gerardin et al. ..... 114/363
3,113,804 A 12/1963 Ritter
3,151,910 A * 10/1964 Larson ..... 114/363
3,718,365 A 2/1973 Gibson
3,851,916 A * 12/1974 Quartullo ..... 114/363
4,086,676 A * 5/1978 Arruza ..... 114/363
4,766,838 A * 8/1988 Johnson ..... 114/363
5,054,738 A * 10/1991 Harding ..... 248/538
5,082,328 A 1/1992 Garelick
5,639,059 A * 6/1997 Nash ..... 114/363
5,899,780 A * 5/1999 Robbins ..... 114/363
6,431,109 B1 * 8/2002 Martin ..... 114/363

* cited by examiner

*Primary Examiner*—Lars A Olson
(74) *Attorney, Agent, or Firm*—Barley Snyder LLC

(57) ABSTRACT

An adjustable fisherman seat assembly includes an elongated base member and a seat section. A mechanism for linearly displacing the seat includes: a linear shaft; a pair of linear slots; a bore; first and second linear arms; a bracket; and first and second pairs of spring members. A mechanism for adjustably pivoting the seat includes: a bar; a support plate; a rod; a toothed wheel; an elbow lever; an actuating arm; and a pawl. A fishing rod holder is statically coupled to the adjustably pivoting mechanism. A mechanism for supporting user feet includes a platform and a support stand. Such a platform has a finger extending downwardly and a locking pin. A plurality of independently compressible spring members is nested within the seat section.

16 Claims, 11 Drawing Sheets

ADJUSTABLE FISHERMAN SEAT ASSEMBLY AND ASSOCIATED METHOD

CROSS REFERENCE TO RELATED APPLICATIONS

This application claims the benefit of U.S. Provisional Application No. 60/789,942, filed Apr. 7, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to seat assemblies for water vessels and, more particularly, to an adjustable fisherman seat assembly for use on a water vessel.

2. Prior Art

There are a number of commercially available swiveled boat seats. Conventionally, the swivel comprises a number of ball bearings suitably and rotatably resting in suitable races or recesses between adjoining disks. One of the disks is normally coupled to the boat seat and the other secured in some fashion to the boat deck, either directly or through a support post or pillar, so that the user can swing the seat around as he or she desires. There are also a number of commercially available slides for boat seats. Although there are known boat seats that are both swivable and slidably adjustable, in general it has been found that these combined swivel-slide boat seats do not operate reliably under the conditions encountered aboard a boat. Oftentimes the swivel cannot stand up to the forces brought to bear on it when the seat is slidably adjusted to various positions. After a while the swivel mechanism will often break or jam up and not operate smoothly. Also, the environmental conditions under which a boat seat is used oftentimes is not compatible with continuous smooth and reliable operation of a conventional ball bearing swivel mechanism, and more so when used in conjunction with a slide adjustment.

U.S. Pat. No. 5,082,328 to Garelick teaches a swivel-slide seat comprised of a pair of metal plates that sandwich a spacer made of low-friction material and a relatively large diameter circular opening that passes through the three members which are held rotatably together by a flared ring or bushing or collar along the edge of the opening. One of the plates is mounted to the floor and a seat is coupled to the other plate. The seat may be attached to a slide carriage comprising one of the aforementioned swivel plates and another rectangular plate. Each plate has tracks and rails along parallel outer edges which slidably mate with respectively corresponding rails and tracks on the other plate. Unfortunately, this prior art example includes swivel plates which allow the seat to swivel, thereby requiring a fisherman to maneuver about the waist in a physically demanding manner.

U.S. Pat. No. 3,718,365 to Gibson teaches a seat attachment for boats which includes a rectangular, tubular main frame having clamp means for detachably securing the frame to the sides of the boat. A subframe carrying a seat is sleevedly engaged with opposed sides of the tubular main frame to permit sliding adjustment of the sub-frame longitudinally of the main frame. Unfortunately, this prior art example cannot be adjusted in angular positioning, plus or minus 20 degrees from horizontal, to suit the preference of the occupant.

U.S. Pat. No. 3,113,804 to Ritter teaches a sliding swivel seat for boats which can be secured to thwarts of varying sizes of boats. The seat is provided with a frame and clamps which adapt it to being secured to the thwart, and the frame is further provided with tracks which receive a wheeled carriage supporting the seat. Through this structure, the seat can slide along the tracks and, through a pivotal connection between the seat and the carriage, swiveling of the seat is provided. Unfortunately, this prior art example includes a pivotal connection that requires a user to control the seat using the waist and thereby demanding excessive physical exertion.

Accordingly, the adjustable fisherman seat assembly is disclosed to overcome the above noted shortcomings. The present invention satisfies such a need by providing an assembly that is convenient and easy to use, lightweight yet durable in design, and ideal for use on a water vessel. The maneuverability of the adjustable fisherman seat assembly and the ability to slide the chair toward the stern or the bow of a boat would make it possible for a fisherman to play a fish without excessive maneuvering about the waist, making the task of landing a fish much less physically demanding and tiring. This, in turn, would make the enjoyable activity of sport fishing even more pleasurable and satisfying. The present invention is simple to use, inexpensive, and designed for many years of repeated use.

BRIEF SUMMARY OF THE INVENTION

In view of the foregoing background, it is therefore an object of the present invention to provide an assembly for use on a water vessel that limits the physical demands related to sport fishing. These and other objects, features, and advantages of the invention are provided by an adjustable fisherman seat assembly.

The adjustable fisherman seat assembly conveniently includes an elongated base member that has axially opposed proximal and distal end portions and a seat section that has a bottom housing effectively connected to the base member.

The assembly further includes a mechanism for linearly displacing the seat along a longitudinal length of the base member such that the seat is selectively positioned along a reciprocating path advantageously defined between the proximal and distal end portions of the base member. Such a linearly displacing mechanism conveniently includes a linear shaft extending parallel to the longitudinal length of the base member and has opposed ends connected to the proximal and distal ends of the base member respectively. The linearly displacing mechanism further includes a pair of linear slots formed within the bottom housing that are defined orthogonal to the shaft. A bore is formed with the bottom housing to thereby allow the shaft to pass therethrough.

First and second linear arms are removably positional within the linear slots respectively and a bracket is statically coupled to the bottom housing and the first and second linear arms respectively. First and second pairs of spring members are positioned about the first and second linear arms respectively. Such first and second pairs of spring members are oppositely seated on inner and outer sides of respective lower portions of the bracket such that the first and second arms are automatically returned to a locked position after they are laterally displaced out from the slots respectively.

The assembly further includes a mechanism for adjustably pivoting the seat along an arcuate path defined along a horizontal plane situated above the base member. Such a pivoting mechanism includes a bar connected to the bottom housing and extending vertically upward therefrom. A support plate is spaced above a top end of the bar and is further statically affixed to the seat section. Advantageously, a rod is fixedly intercalated between the support plate and the bar with a toothed wheel concentrically positioned about the rod. Such a toothed wheel is fixedly mated with the rod such that the rod and the toothed wheel effectively rotate in sync. An elbow lever is directly connected to a center of the toothed wheel and an actuating arm that has a first end is directly mated to the elbow lever and advantageously extends outwardly therefrom in such a manner that the elbow lever is selectively rotatable about a fulcrum axis defined parallel to the rod. A pawl is pivotally coupled to the elbow lever and spaced from the arm. Such a pawl is selectively interfitted within the a corrugated outer surface of the toothed wheel based upon a corresponding linear motion of the arm such that the plate and the seat section are conveniently pivoted about the fulcrum axis during operating conditions.

Such a linear-to-rotational movement allows the user to pivot the seat section in clockwise and counter clockwise direction while maintaining one hand permanently positioned on the fishing rod. A free hand of the user is grasped about the actuating arm during operating conditions. Therefore, the present invention provides an ergonomic and simply mechanism that allows the user to advantageously bias the seat section without loosing control of the fishing rod.

The assembly further includes a fishing rod holder statically coupled to the adjustably pivoting mechanism and effectively extending outwardly therefrom along a path elevated above the base member wherein the linearly displacing mechanism and the adjustably pivoting mechanism are simultaneously and independently operable by the user.

The assembly further includes a mechanism for advantageously supporting user feet above the base member and at an elevated angle offset from the horizontal plane such that the user feet conveniently remain distally positioned in front of the user during operating conditions. Such a user feet supporting mechanism includes a platform that has a planar bottom portion and an arcuate upper portion monolithically formed therewith. A support stand is anchored to the distal end of the base member and is statically engaged with the base member. Such a platform is effectively provided with a finger extending downwardly therefrom and pivotally attached to a top end of the support stand such that the platform is freely articulated along an arcuate path distally spaced from the seat section. A locking pin is threadably mated with the top end of the support stand and the finger respectively to thereby advantageously prohibit arcuate movement of the platform during operating conditions.

The assembly further includes a plurality of independently compressible spring members conveniently nested within the seat section that is resiliently adaptable along a vertical path for absorbing operating forces.

A method for allowing a fisherman to adjust a seating position during fishing operations on a water vessel while maintaining control over a fishing rod includes the steps of: providing an elongated base member that has axially opposed proximal and distal end portions; connecting a bottom housing of a seat section to the base member; linearly displacing the seat along a longitudinal length of the base member such that the seat is selectively positioned along a reciprocating path defined between the proximal and distal end portions of the base member; adjustably pivoting the seat along an arcuate path defined along a horizontal plane situated above the base member; and statically coupling a fishing rod holder to the seat section and that extends outwardly therefrom along a path elevated above the base member.

The method further includes the steps of: providing a linear shaft that extends parallel to the longitudinal length of the base member and has opposed ends connected to the proximal and distal ends of the base member respectively; providing a pair of linear slots formed within the bottom housing that are defined orthogonal to the shaft; providing a bore formed with the bottom housing with the shaft passing through the bore; removably positioning first and second linear arms within the linear slots respectively; statically coupling a bracket to the bottom housing and the first and second linear arms respectively; and positioning first and second pairs of spring members about the first and second linear arms respectively. The first and second pairs of spring members are oppositely seated on inner and outer sides of respective lower portions of the bracket such that the first and second arms are automatically returned to a locked position after they are laterally displaced out from the slots respectively.

The method further includes the steps of: connecting a bar to the bottom housing and extending vertically upward therefrom; statically affixing a support plate above a top end of the bar and to the seat section respectively; fixedly intercalating a rod between the support plate and the bar; concentrically positioning a toothed wheel about rod and fixedly mating therewith such that the rod and the toothed wheel rotate in sync; directly connecting an elbow lever to a center of the toothed wheel; directly mating a first end of an actuating arm to the elbow lever and extending outwardly therefrom in such a manner that the elbow lever is selectively rotatable about a fulcrum axis defined parallel to the rod; and pivotally coupling a pawl to the elbow lever and spaced from the arm that is selectively interfitted within the a corrugated outer surface of the toothed wheel based upon a corresponding linear motion of the arm such that the plate and the seat section are pivoted about the fulcrum axis during operating conditions.

The method further includes the steps of: supporting user feet above the base member at an elevated angle offset from the horizontal plane such that the user feet remain distally positioned in front of the user during operating conditions. The method further includes the steps of providing a platform that has a planar bottom portion and an arcuate upper portion monolithically formed therewith; anchoring a support stand to the distal end of the base member that is statically engaged with the base member; providing a finger extending downwardly from the platform that is pivotally attached to a top end of the support stand such that the platform is freely articulated along an arcuate path distally spaced from the seat section; and threadably mating a locking pin with the top end of the support stand and the finger respectively to thereby prohibit arcuate movement of the platform during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figures 1, 2, 3:
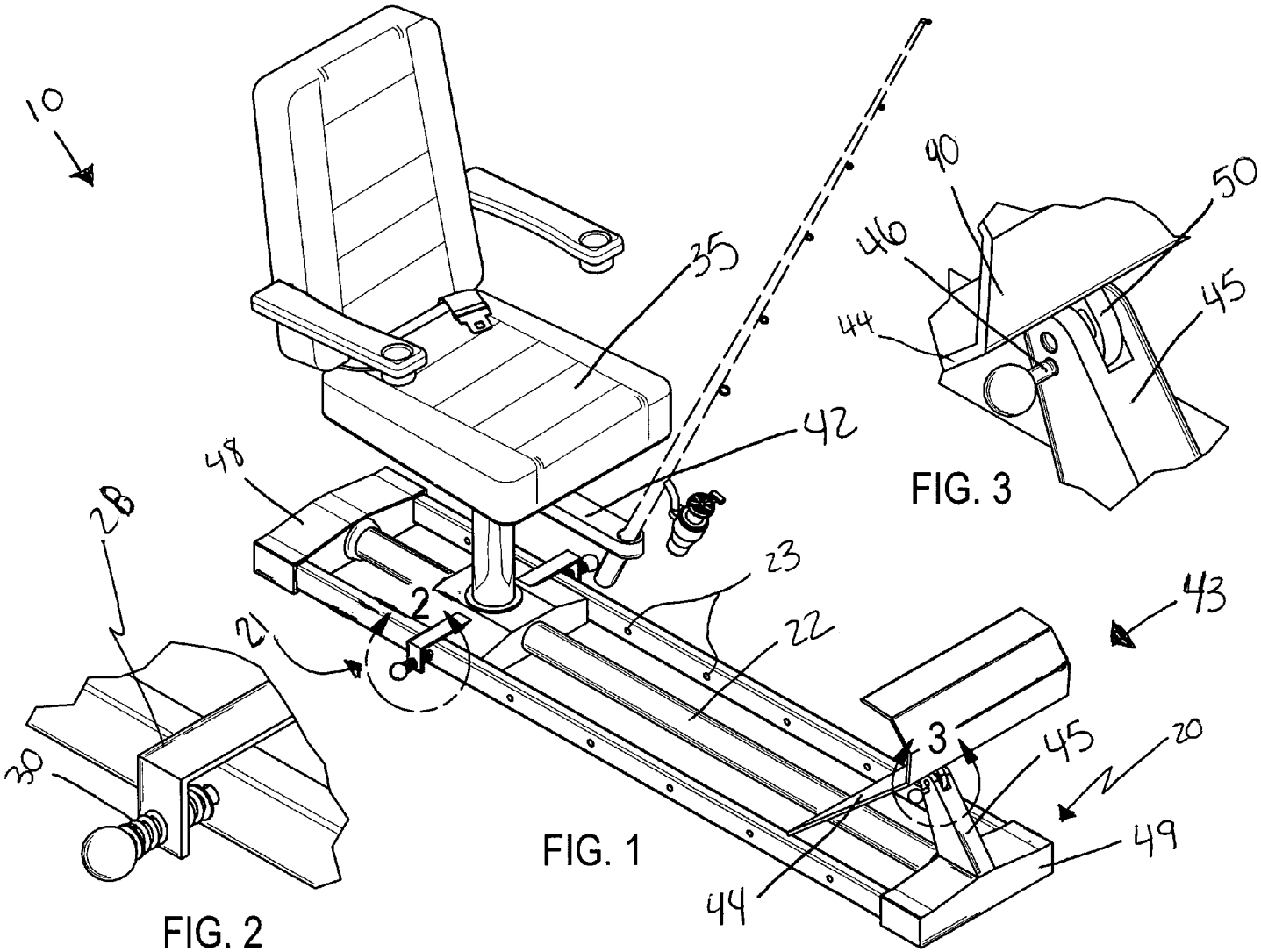
FIG. 1 is a perspective view taken along the right side of the present invention.
FIG. 2 is an enlarged view of the linearly displacing mechanism taken along segment 2 as shown in FIG. 1.
FIG. 3 is an enlarged view of the feet supporting mechanism taken along segment 3 as shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly is referred to generally in FIGS. 1-15 by the reference numeral 10 and is intended to protect an adjustable fisherman seat assembly. It should be understood that the assembly 10 may be used on many different types of water vessels and should not be limited in use to only those types of water vessels described herein.

Referring initially to FIG. 1, the adjustable fisherman seat assembly conveniently includes an elongated base member 20 that has axially opposed proximal and distal end portions and a seat section that has a bottom housing effectively connected to the base member 20.

Figure 11:
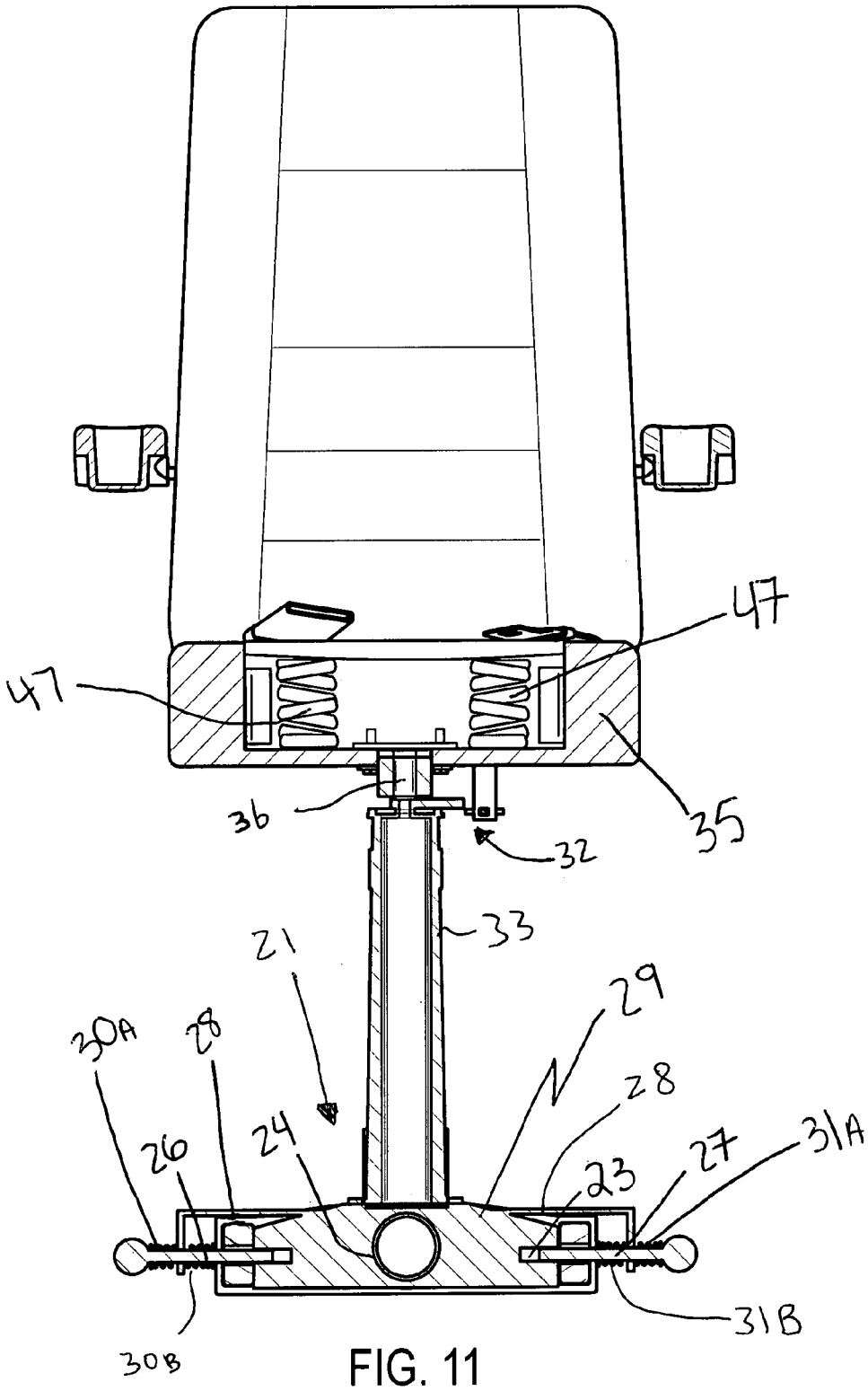
FIG. 11 is an enlarged cross sectional view taken along line 11-11 as shown in FIG. 7.

Referring to FIGS. 1, 2 and 11, the assembly further includes a mechanism for linearly displacing the seat along a longitudinal length of the base member 20 such that the seat is selectively positioned along a reciprocating path advantageously defined between the proximal and distal end portions of the base member 20. Such a linearly displacing mechanism 21 conveniently includes a linear shaft 22 that extends parallel to the longitudinal length of the base member 20 and has opposed ends 48, 49 connected to the proximal and distal ends of the base member 20 respectively. The linearly displacing mechanism 21 further includes a pair of linear slots 23 formed within the bottom housing 29 that are defined orthogonal to the shaft 22. A bore 24 is formed with the bottom housing, and the shaft 22 passes through the bore 24.

First and second linear arms 26, 27 are removably positional within the linear slots 23 respectively and a bracket 28 is statically coupled to the bottom housing 29 and the first and second linear arms respectively 26, 27. First and second pairs of spring members 30*a*, 30*b*, 31*a*, 31*b* are positioned about the first and second linear arms 26, 27 respectively. Such first and second pairs of spring members 30*a*, 30*b*, 31*a*, 31*b* are oppositely seated on inner and outer sides of respective lower portions of the bracket 28 which is critical such that the first and second arms 26, 27 are automatically returned to a locked position after they are laterally displaced out from the slots 23 respectively. Such first and second arms 26, 27 allow a user to choose a specific positioning of the seat and to thereby remain in that position until a user chooses to move to a new position by adjusting the first and second arms.

Figure 13:
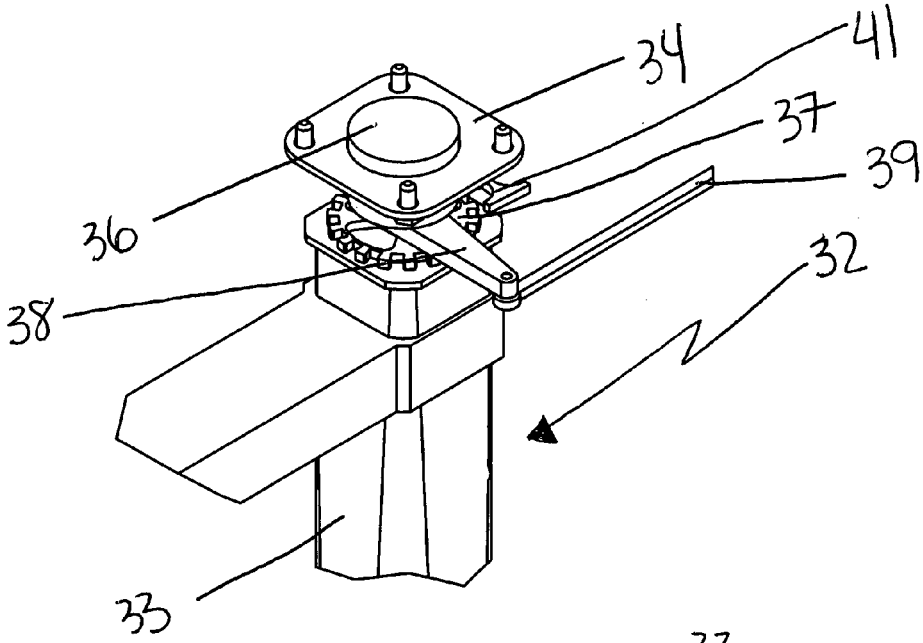
FIG. 13 is an enlarged view of the adjustable pivoting mechanism taken along segment 13 as shown in FIG. 12.
Figure 12:
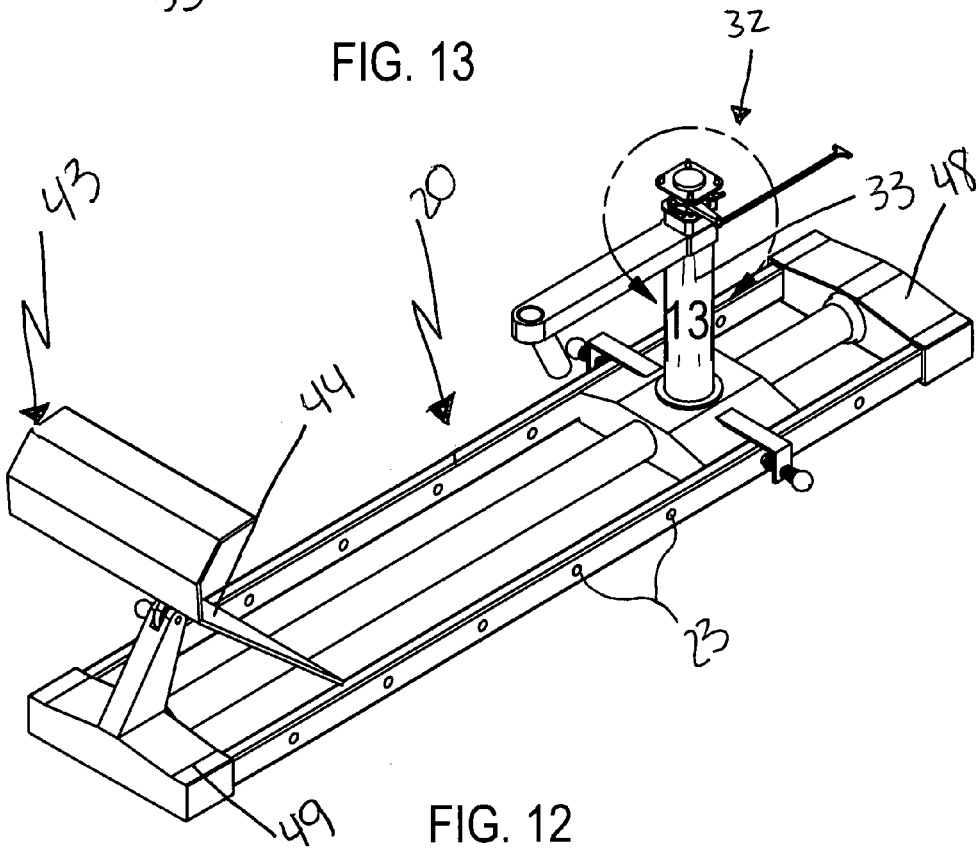
FIG. 12 is a perspective view showing the adjustable pivoting mechanism of the seat section, in accordance with the present invention.
Figure 14:
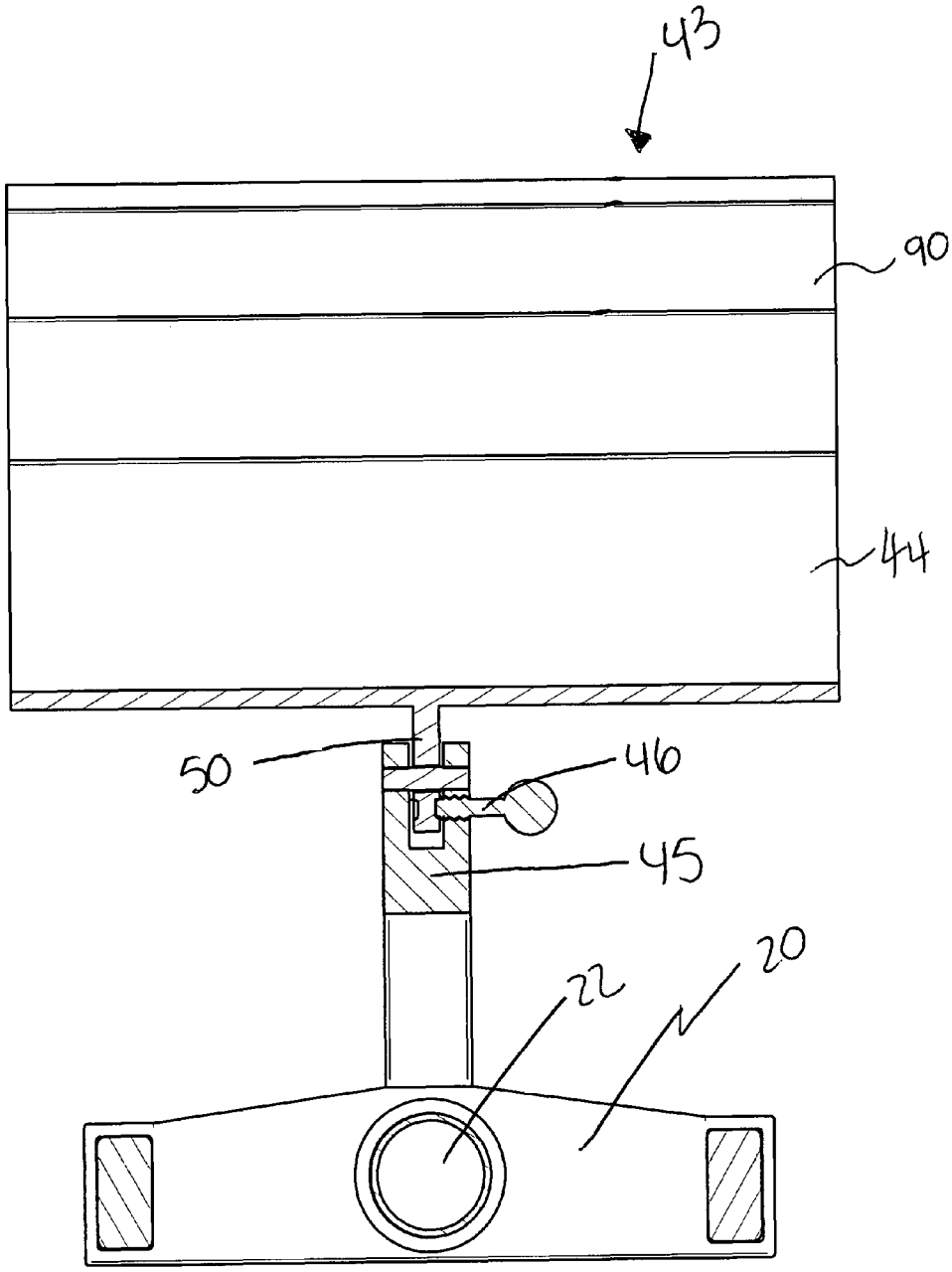
FIG. 14 is an enlarged view of the feet support mechanism taken along line 14-14 as shown in FIG. 6.
Figure 15:
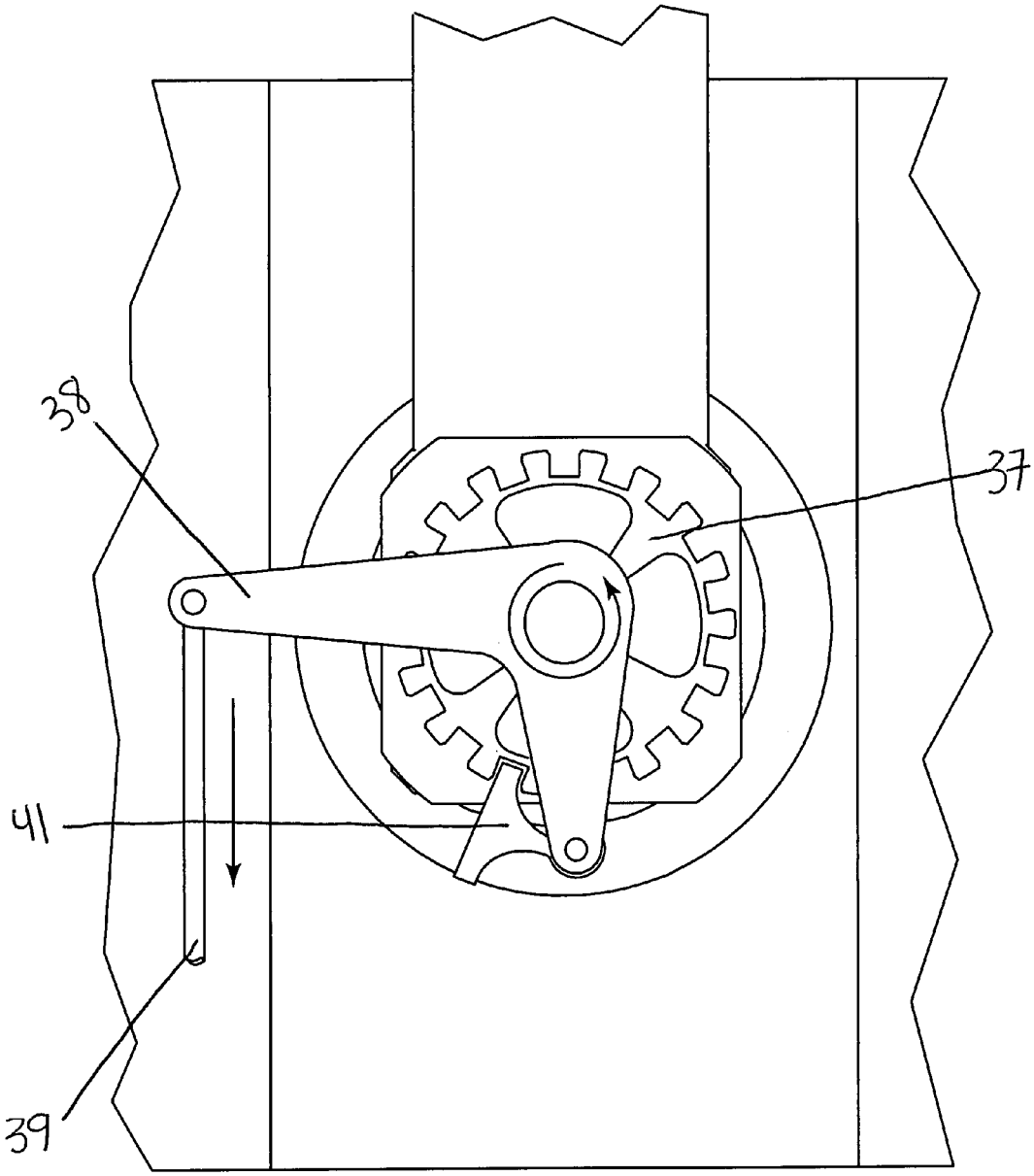
FIG. 15 is a top plan view of the adjustable pivoting mechanism as show in FIG. 12.

Referring to FIGS. 12, 13 and 15, the assembly further includes a mechanism for adjustably pivoting the seat along an arcuate path defined along a horizontal plane situated above the base member 20. Such a pivoting mechanism 32 includes a bar 33 connected to the bottom housing and extending vertically upward therefrom. A support plate 34 is spaced above a top end of the bar 33 and statically affixed to the seat section 35. A rod 36 is fixedly intercalated between the support plate 34 and the bar 33, and a toothed wheel 37 is concentrically positioned about the rod 36 and fixedly mated therewith such that the rod 36 and the toothed wheel 37 effectively rotate in sync.

An elbow lever 38 is directly, without the use of intervening elements, connected to a center of the toothed wheel 37. Such an actuating arm 39 has a first end directly, without the use of intervening elements, mated to the elbow lever 38 and advantageously extends outwardly therefrom in such a manner that the elbow lever 38 is selectively rotatable about a fulcrum axis 40 defined parallel to the rod. A pawl 41 is pivotally coupled to the elbow lever 38 and spaced from the arm 39. Such a pawl 41 is selectively interfitted within the a corrugated outer surface of the toothed wheel 37 based upon a corresponding linear motion of the arm 39 which is essential such that the plate 34 and the seat section 35 are pivoted about the fulcrum axis 40 during operating conditions. Such an adjustably pivoting mechanism 32 allows a user to turn the seat 35 in any direction using an easily accessible actuating arm 38 and provides a user the benefit of controlling the turning motions of the seat 35 at all times.

Figure 4:
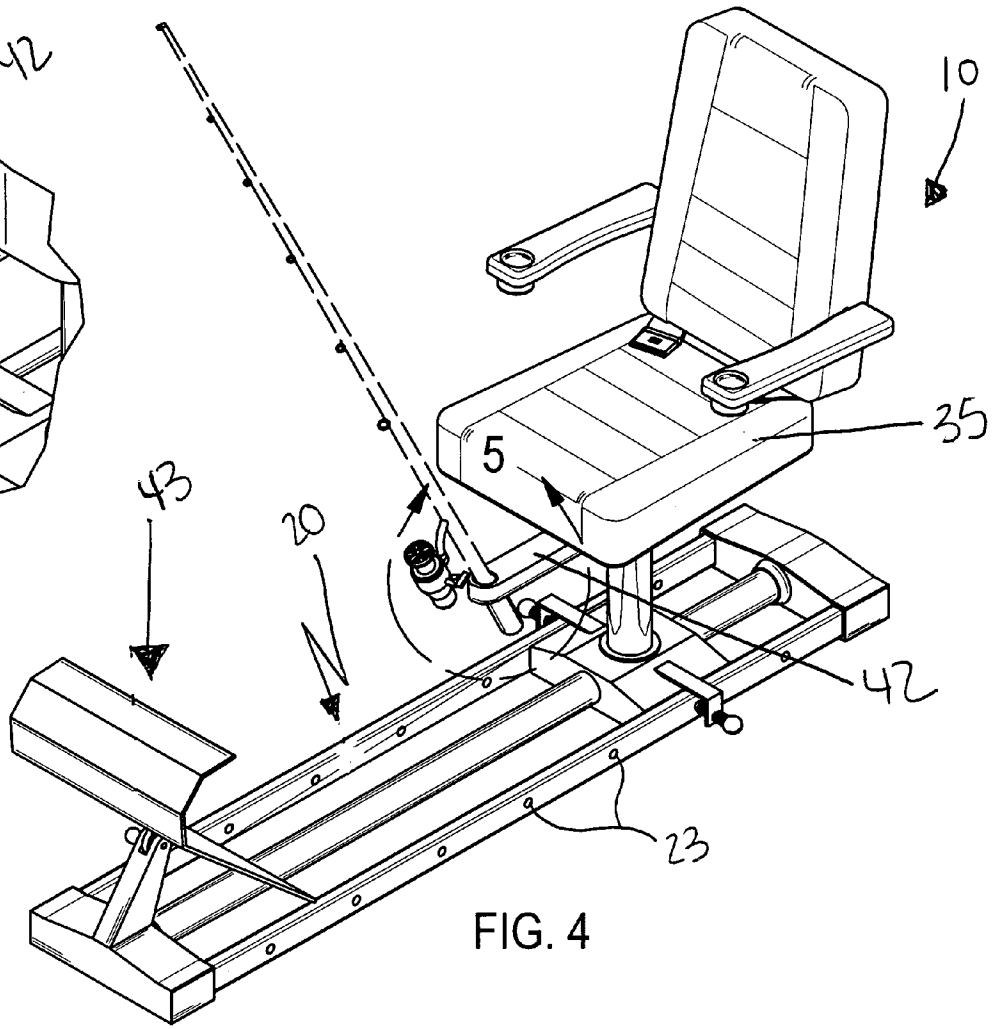
FIG. 4 is a perspective view taken along the left side of the present invention.
Figure 5:
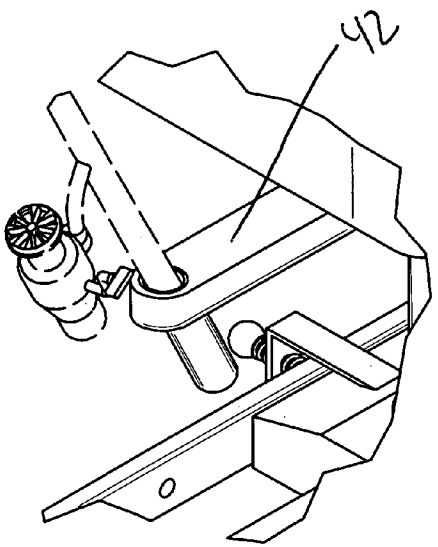
FIG. 5 is an enlarged view of the fishing rod holder taken along segment 5 as shown in FIG. 4.
Figure 6:
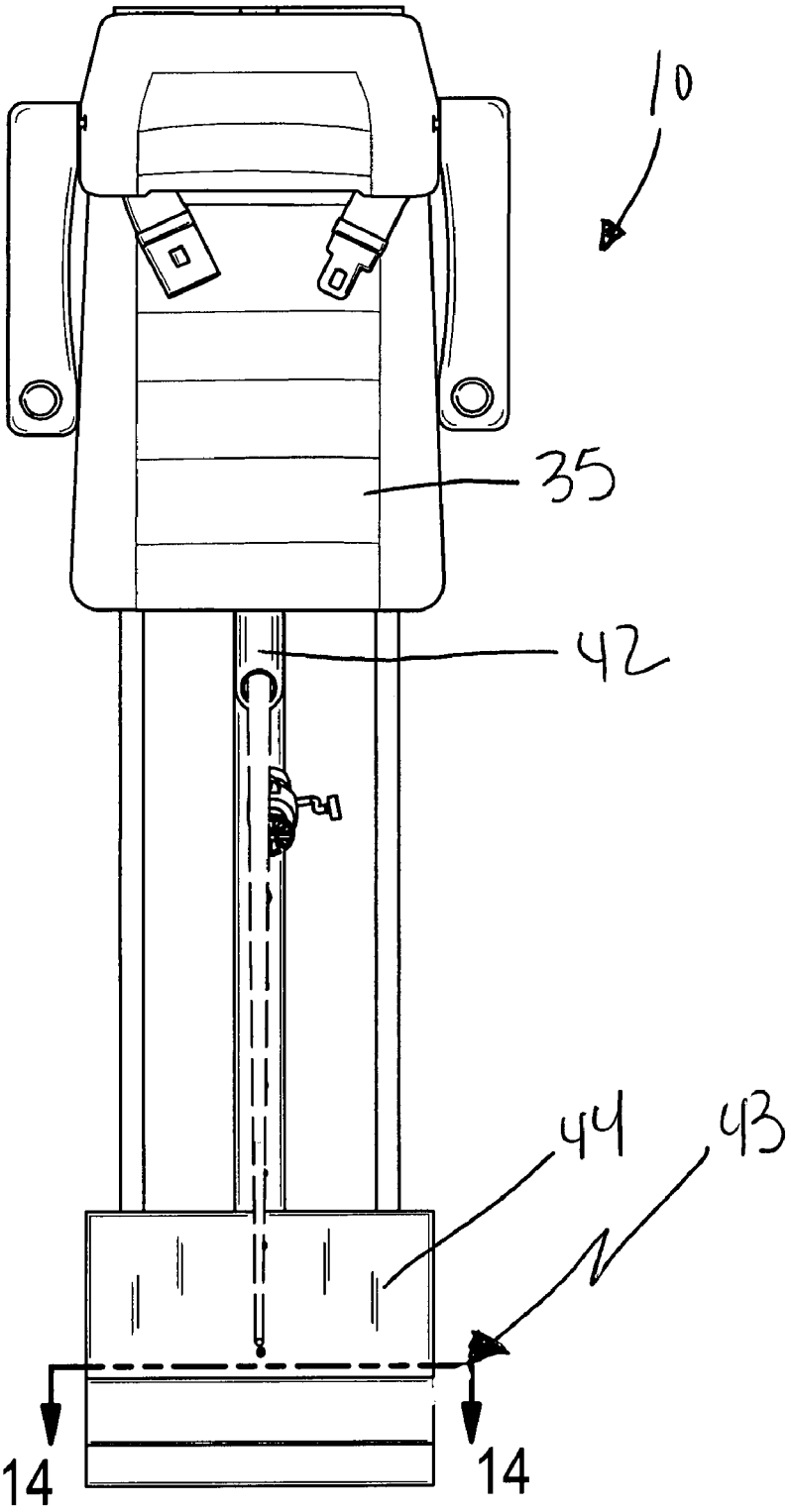
FIG. 6 is a top plan view in accordance with the present invention.
Figure 7:
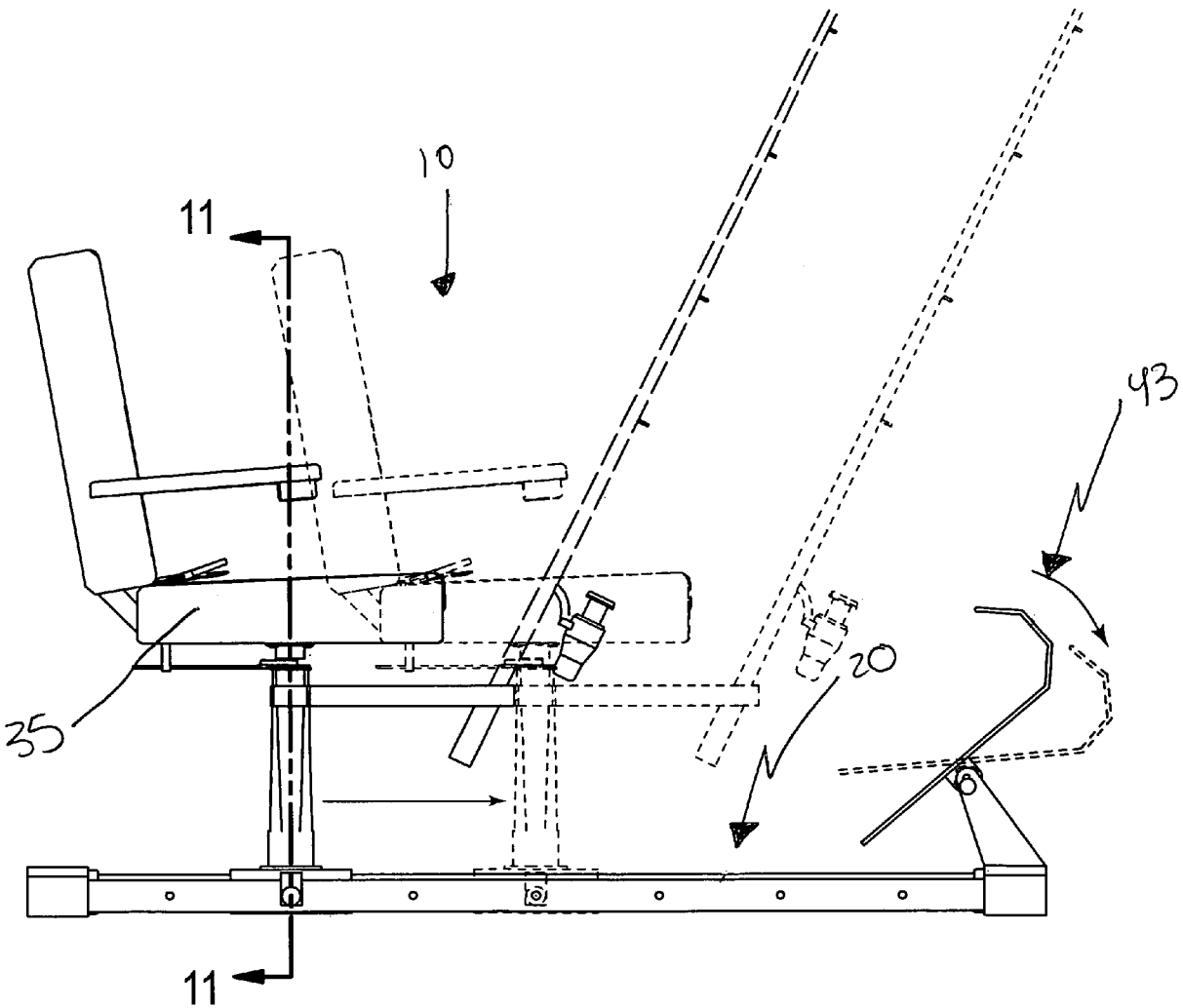
FIG. 7 is a side elevational view showing linear displacement of the seat section and the pivotal rotation of the feet supporting mechanism, in accordance with the present invention.
Figure 8:
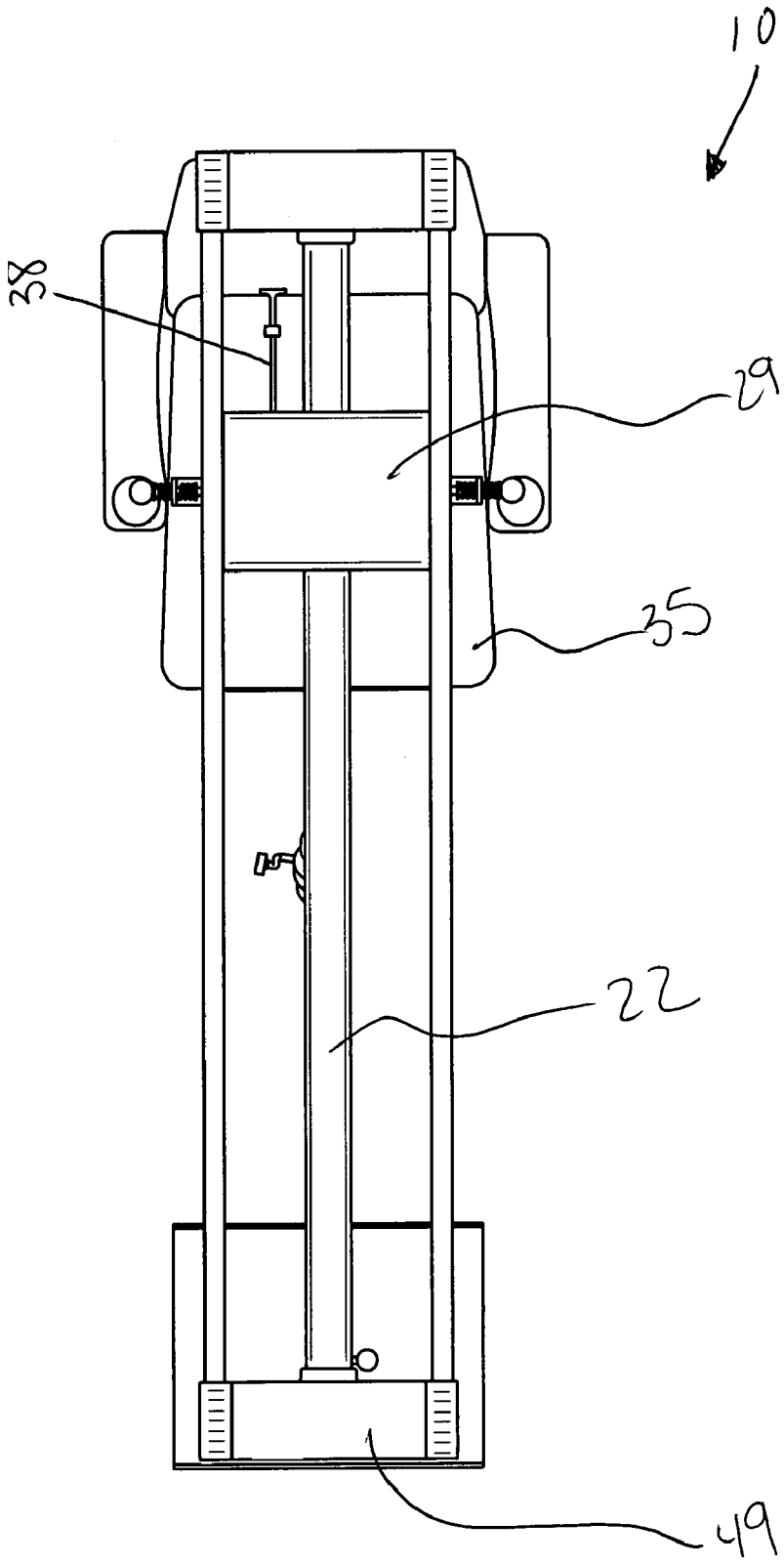
FIG. 8 is a bottom plan view of the present invention.
Figure 9:
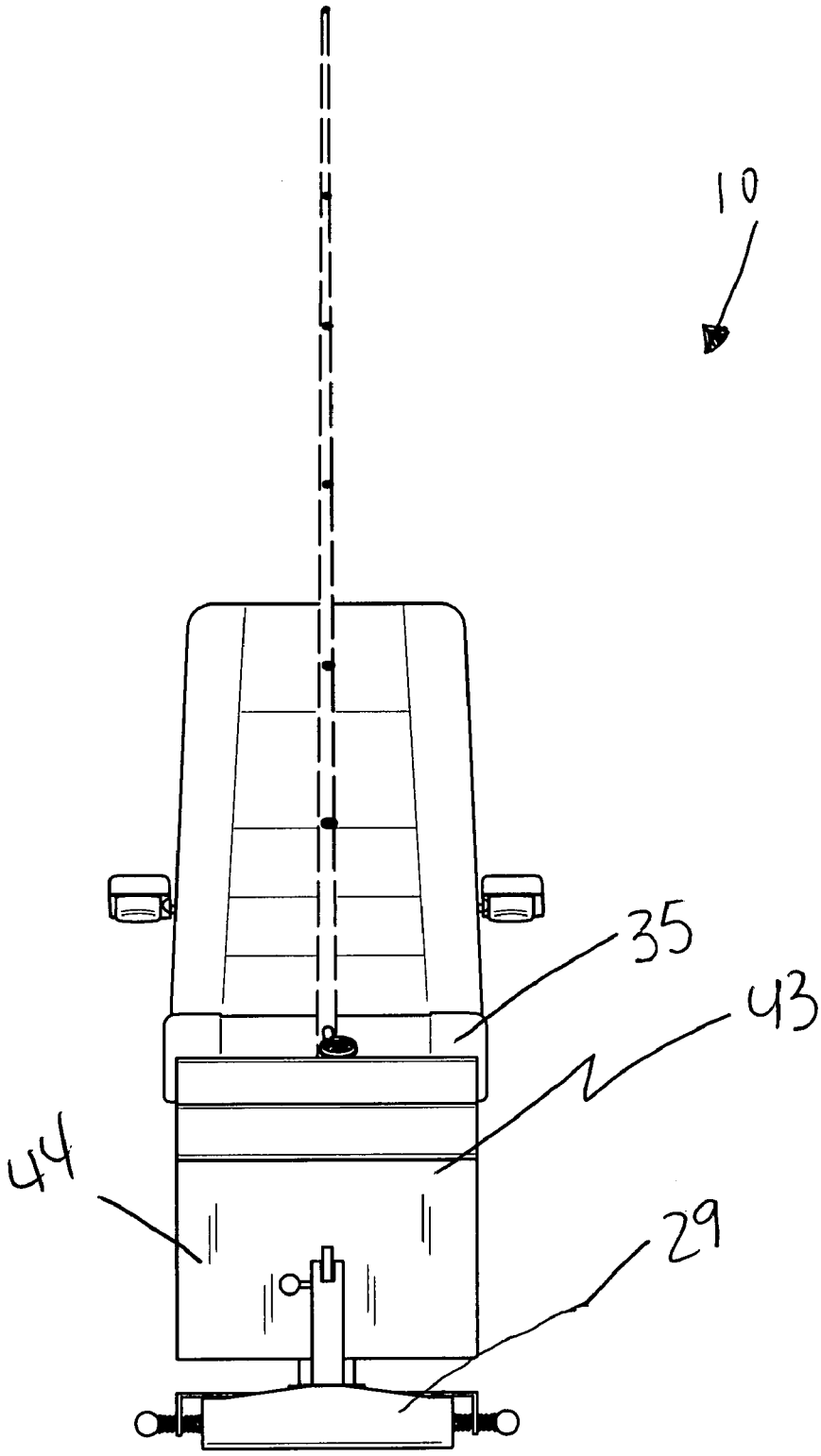
FIG. 9 is a front elevational view of the present invention.
Figure 10:
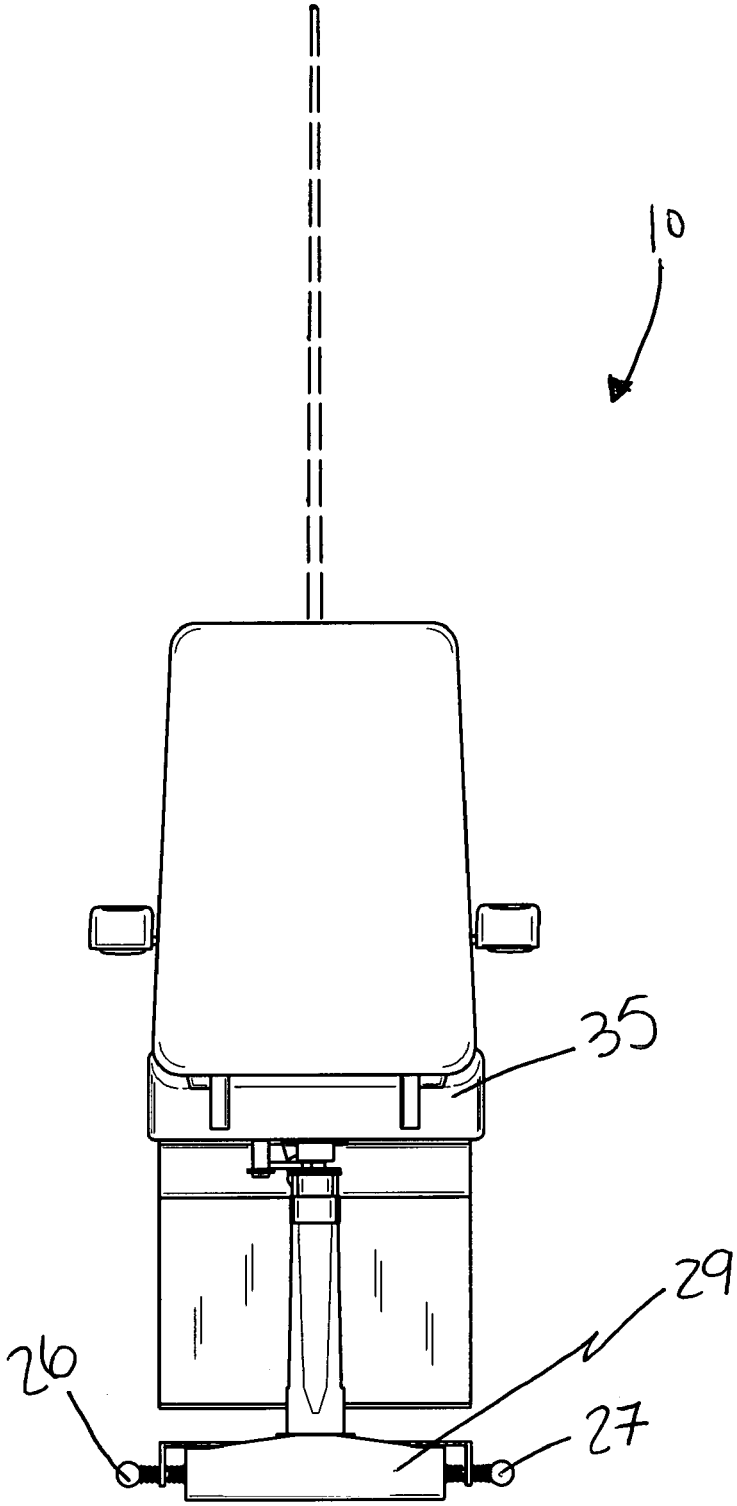
FIG. 10 is a rear elevational view of the present invention.

Referring to FIGS. 4 and 5, the assembly further includes a fishing rod holder 42 statically coupled to the adjustably pivoting mechanism 32 and effectively extending outwardly therefrom along a path elevated above the base member 20 wherein the linearly displacing mechanism 21 and the adjustably pivoting mechanism 32 are simultaneously and independently operable by the user. Such a fishing rod holder 42 allows a user to continuing fishing even when the user is not manually operating the rod.

Referring to FIGS. 1, 3, 6 and 14, the assembly further includes a mechanism for supporting user feet above the base member 20 at an elevated angle offset from the horizontal plane which is crucial such that the user feet conveniently remain distally positioned in front of the user during operating conditions. Such a user feet supporting mechanism 43 includes a platform that has a planar bottom portion 44 and an arcuate upper portion 90 monolithically formed therewith and a support stand 45 anchored to the distal end of the base member 20 that is statically engaged with the base member 20. Such a platform is provided with a finger 50 that extends downwardly therefrom and is pivotally attached to a top end of the support stand 45 which is vital such that the platform is freely articulated along an arcuate path distally spaced from the seat section 35. A locking pin 46 is threadably mated with the top end of the support stand 45 and the finger 50 respectively which is necessary to thereby prohibit arcuate movement of the platform during operating conditions. The platform allows a user to rest his/her feet while sport fishing, thereby making the activity more relaxing and enjoyable.

Referring to FIG. 11, the assembly further includes a plurality of independently compressible spring members 47 conveniently nested within the seat section 35 that is resiliently adaptable along a vertical path which is important for absorbing operating forces.

The adjustably pivoting mechanism 32 provides the unexpected benefit of allowing a user to manually pivot the seat when necessary without requiring demanding physical movements of the waist and continuous unwanted movements of the seat at other times. In addition, a fishing rod holder 42 allows a user to rest his arms, at times, without giving up the opportunity of making a catch. Such benefits overcome the prior art shortcomings.

In use, a method for allowing a fisherman to adjust a seating position during fishing operations on a water vessel while maintaining control over a fishing rod includes the steps of: providing an elongated base member 20 that has axially opposed proximal and distal end portions; connecting a bottom housing of a seat section 35 to the base member 20; linearly displacing the seat 35 along a longitudinal length of the base member 20 such that the seat is selectively positioned along a reciprocating path defined between the proximal and distal end portions of the base member 20; adjustably pivoting the seat 35 along an arcuate path defined along a horizontal plane situated above the base member 20; and statically coupling a fishing rod holder 42 to the seat section 35 and that extends outwardly therefrom along a path elevated above the base member 20.

In use, the steps further include: providing a linear shaft 22 that extends parallel to the longitudinal length of the base member 20 and has opposed ends connected to the proximal and distal ends of the base member 20 respectively; providing a pair of linear slots 23 formed within the bottom housing that are defined orthogonal to the shaft 22; providing a bore 24 formed with the bottom housing with the shaft 22 passing through the bore 24; removably positioning first and second linear arms 26, 27 within the linear slots 23 respectively; statically coupling a bracket 28 to the bottom housing and the first and second linear arms 26, 27 respectively; and positioning first and second pairs of spring members 47 about the first and second linear arms 26, 27 respectively. The first and second pairs of spring members 47 are oppositely seated on inner and outer sides of respective lower portions of the bracket 28 such that the first and second arms 26, 27 are automatically returned to a locked position after they are laterally displaced out from the slots respectively.

In use, the steps further include connecting a bar 33 to the bottom housing and extending vertically upward therefrom; statically affixing a support plate 34 above a top end of the bar and to the seat section 35 respectively; fixedly intercalating a rod 36 between the support plate 34 and the bar 33; concentrically positioning a toothed wheel 37 about the rod 36 and fixedly mating therewith such that the rod 36 and the toothed wheel 37 rotate in sync; directly, without the use of intervening elements, connecting an elbow lever 38 to a center of the toothed wheel 37; directly, without the use of intervening elements, mating a first end of an actuating arm 39 to the elbow lever 38 and extending outwardly therefrom in such a manner that the elbow lever 38 is selectively rotatable about a fulcrum axis defined parallel to the rod 36; and pivotally coupling a pawl 41 to the elbow lever 38 and spaced from the arm 39 that is selectively interfitted within the a corrugated outer surface of the toothed wheel based upon a corresponding linear motion of the arm 39 such that the plate 34 and the seat section 35 are pivoted about the fulcrum axis 40 during operating conditions.

In use, the steps further include supporting user feet above the base member 20 at an elevated angle offset from the horizontal plane such that the user feet remain distally positioned in front of the user during operating conditions. The steps further include providing a platform that has a planar bottom portion 44 and an arcuate upper portion 90 monolithically formed therewith; anchoring a support stand 45 to the distal end of the base member 20 that is statically engaged with the base member 20; providing a finger 50 extending downwardly from the platform that is pivotally attached to a top end of the support stand 45 such that the platform is freely articulated along an arcuate path distally spaced from the seat section 35; and threadably mating a locking pin with the top end of the support stand 45 and the finger 50 respectively to thereby prohibit arcuate movement of the platform during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable fisherman seat assembly for use on a water vessel, said fisherman seat assembly comprising:

an elongated base member having axially opposed proximal and distal end portions;

a seat section having a bottom housing connected to said base member;

means for linearly displacing said seat section along a longitudinal length of said base member such that said seat section is selectively positioned along a reciprocating path defined between said proximal and distal end portions of said base member; and means for adjustably pivoting said seat section along an arcuate path defined along a horizontal plane situated above said base member;

wherein said linearly displacing means and said adjustably pivoting means are simultaneously and independently operable by a user; and means fixed to said base member for supporting the user feet above said base member such that the user feet remain positioned in front of the user during operating conditions.

2. The fisherman seat assembly of claim 1, wherein said user feet supporting means comprises:

a platform having a planar bottom portion and an arcuate upper portion monolithically formed therewith;

a support stand anchored to the distal end of said base member, said support stand being statically engaged with said base member;

wherein said platform is provided with a finger extending downwardly therefrom and pivotally attached to a top end of said support stand such that said platform is freely articulated along an arcuate path distally spaced from said seat section; and a locking pin threadably mated with said top end of said support stand and said finger respectively to thereby prohibit arcuate movement of said platform during operating conditions.

3. The fisherman seat assembly of claim 1, further comprising:

a plurality of independently compressible spring members nested within said seat section, said spring members being resiliently adaptable along a vertical path for absorbing operating forces.

4. An adjustable fisherman seat assembly for use on a water vessel, said fisherman seat assembly comprising:

an elongated base member having axially opposed proximal and distal end portions;

a seat section having a bottom housing connected to said base member;

means for linearly displacing said seat section along a longitudinal length of said base member such that said seat section is selectively positioned along a reciprocating path defined between said proximal and distal end portions of said base member; said linear displacing means including:

a. a linear shaft extending parallel to the longitudinal length of said base member and having opposed ends connected to said proximal and distal ends of said base member respectively;

b. a pair of linear slots formed within said bottom housing, said slots being defined orthogonal to said shaft;

c. a bore formed within said bottom housing, said shaft passing through said bore;

d. first and second linear arms removably positional within said linear slots respectively;

e. a bracket statically coupled to said bottom housing and said first and second linear arms respectively; and f. first and second pairs of spring members positioned about said first and second linear arms respectively, said first and second pairs of spring members being oppositely seated on inner and outer sides of respective lower portions of said bracket such that said first and second arms are automatically returned to a locked position after being laterally displaced out from said slots respectively;

means for adjustably pivoting said seat section along an arcuate path defined along a horizontal plane situated above said base member; and wherein said linearly displacing means and said adjustably pivoting means are simultaneously and independently operable by a user.

5. The fisherman seat assembly of claim 4, wherein said adjustably pivoting means comprises:

a bar connected to said bottom housing and extending vertically upward therefrom;

a support plate spaced above a top end of said bar and statically affixed to said seat section;

a toothed wheel concentrically positioned about said rod and fixedly mated therewith such that said rod and said toothed wheel rotate in synchronization;

an elbow lever directly connected to a center of said toothed wheel;

an actuating arm having a first end directly mated to said elbow lever and extending outwardly therefrom in such a manner that said elbow lever is selectively rotatable about a fulcrum axis defined parallel to said rod; and a pawl pivotally coupled to said elbow lever and spaced from said arm, said pawl being selectively interfitted within said a corrugated outer surface of said toothed wheel based upon a corresponding linear motion of said arm such that said plate and said seat section are pivoted about the fulcrum axis during operating conditions.

6. An adjustable fisherman seat assembly for use on a water vessel, said fisherman seat assembly comprising:

an elongated base member having axially opposed proximal and distal end portions;

a seat section having a bottom housing connected to said base member;

means for linearly displacing said seat section along a longitudinal length of said base member such that said seat section is selectively positioned along a reciprocating path defined between said proximal and distal end portions of said base member;

means for adjustably pivoting said seat section along an arcuate path defined along a horizontal plane situated above said base member; and a fishing rod holder statically coupled to said adjustably pivoting means and extending outwardly therefrom along a path elevated above said base member;

wherein said linearly displacing means and said adjustably pivoting means are simultaneously and independently operable by a user; and means fixed to said base member for supporting the user feet above said base member such that the user feet remain positioned in front of the user during operating conditions.

7. The fisherman seat assembly of claim 6, further comprising:

a plurality of independently compressible spring members nested within said seat section, said spring members being resiliently adaptable along a vertical path for absorbing operating forces.

8. An adjustable fisherman seat assembly for use on a water vessel, said fisherman seat assembly comprising:

an elongated base member having axially opposed proximal and distal end portions;

a seat section having a bottom housing connected to said base member;

means for linearly displacing said seat section along a longitudinal length of said base member such that said seat section is selectively positioned along a reciprocating path defined between said proximal and distal end portions of said base member, said linear displacing means including;

a. a linear shaft extending parallel to the longitudinal length of said base member and having opposed ends connected to said proximal and distal ends of said base member respectively;

b. a pair of linear slots formed within said bottom housing, said slots being defined orthogonal to said shaft;

c. a bore formed within said bottom housing, said shaft passing through said bore;

d. first and second linear arms removably positional within said linear slots respectively;

e. a bracket statically coupled to said bottom housing and said first and second linear arms respectively; and f. first and second pairs of spring members positioned about said first and second linear arms respectively, said first and second pairs of spring members being oppositely seated on inner and outer sides of respective lower portions of said bracket such that said first and second arms are automatically returned to a locked position after being laterally displaced out from said slots respectively;

means for adjustably pivoting said seat section along an arcuate path defined along a horizontal plane situated above said base member; and a fishing rod holder statically coupled to said adjustably pivoting means and extending outwardly therefrom along a path elevated above said base member; and wherein said linearly displacing means and said adjustably pivoting means are simultaneously and independently operable by a user.

9. The fisherman seat assembly of claim 8, wherein said adjustably pivoting means comprises:

a bar connected to said bottom housing and extending vertically upward therefrom;

a support plate spaced above a top end of said bar and statically affixed to said seat section;

a rod fixedly intercalated between said support plate and said bar;

a toothed wheel concentrically positioned about said rod and fixedly mated therewith such that said rod and said toothed wheel rotate in synchronization;

an elbow lever directly connected to a center of said toothed wheel;

an actuating arm having a first end directly mated to said elbow lever and extending outwardly therefrom in such a manner that said elbow lever is selectively rotatable about a fulcrum axis defined parallel to said rod; and a pawl pivotally coupled to said elbow lever and spaced from said arm, said pawl being selectively interfitted within a corrugated outer surface of said toothed wheel based upon a corresponding linear motion of said arm such that said plate and said seat section are pivoted about the fulcrum axis during operating conditions.

10. An adjustable fisherman seat assembly for use on a water vessel, said fisherman seat assembly comprising:

an elongated base member having axially opposed proximal and distal end portions;

a seat section having a bottom housing connected to said base member;

means for linearly displacing said seat section along a longitudinal length of said base member such that said seat section is selectively positioned along a reciprocating path defined between said proximal and distal end portions of said base member;

means for adjustably pivoting said seat section along an arcuate path defined along a horizontal plane situated above said base member; and a fishing rod holder statically coupled to said adjustably pivoting means and extending outwardly therefrom along a path elevated above said base member;

wherein said linearly displacing means and said adjustably pivoting means are simultaneously and independently operable by a user; and means fixed to said base member for supporting user feet above said base member and at an elevated angle offset from the horizontal plane such that the user feet remain distally positioned in front of the user during operating conditions.

11. The fisherman seat assembly of claim 10, wherein said user feet supporting means comprises:

a platform having a planar bottom portion and an arcuate upper portion monolithically formed therewith;

a support stand anchored to the distal end of said base member, said support stand being statically engaged with said base member;

wherein said platform is provided with a finger extending downwardly therefrom and pivotally attached to a top end of said support stand such that said platform is freely articulated along an arcuate path distally spaced from said seat section; and a locking pin threadably mated with said top end of said support stand and said finger respectively to thereby prohibit arcuate movement of said platform during operating conditions.

12. A method for allowing a fisherman to adjust a seating position during fishing operations on a water vessel while maintaining control over a fishing rod, said method comprising the steps of:

a. providing an elongated base member having axially opposed proximal and distal end portions;

b. connecting a bottom housing of a seat section to said base member;

c. linearly displacing said seat section along a longitudinal length of said base member such that said seat section is selectively positioned along a reciprocating path defined between said proximal and distal end portions of said base member;

d. adjustably pivoting said seat section along an arcuate path defined along a horizontal plane situated above said base member;

e. statically coupling a fishing rod holder to said seat section and extending outwardly therefrom along a path elevated above said base member; and f. mounting on said base member a support for a user feet above said base member such that the user feet remain positioned in front of the user during operating conditions.

13. A method for allowing a fisherman to adjust a seating position during fishing operations on a water vessel while maintaining control over a fishing rod, said method comprising the steps of:

a. providing an elongated base member having axially opposed proximal and distal end portions;

b. connecting a bottom housing of a seat section to said base member;

c. linearly displacing said seat section along a longitudinal length of said base member such that said seat section is selectively positioned along a reciprocating path defined between said proximal and distal end portions of said base member, including the steps of:

i. providing a linear shaft extending parallel to the longitudinal length of said base member and having opposed ends connected to said proximal and distal ends of said base member respectively;

ii. providing a pair of linear slots formed within said bottom housing, said slots being defined orthogonal to said shaft;

iii. providing a bore formed within said bottom housing, said shaft passing through said bore;

iv. removably positioning first and second linear arms within said linear slots respectively;

v. statically coupling a bracket to said bottom housing and said first and second linear arms respectively; and vi. positioning first and second pairs of spring members about said first and second linear arms respectively, said first and second pairs of spring members being oppositely seated on inner and outer sides of respective lower portions of said bracket such that said first and second arms are automatically returned to a locked position after being laterally displaced out from said slots respectively;

d. adjustably pivoting said seat section along an arcuate path defined along a horizontal plane situated above said base member; and e. statically coupling a fishing rod holder to said seat section and extending outwardly therefrom along a path elevated above said base member.

14. The method of claim 13, wherein step d. comprises the steps of:

i. connecting a bar to said bottom housing and extending vertically upward therefrom;

ii. statically affixing a support plate above a top end of said bar and to said seat section respectively;

iii. fixedly intercalating a rod between said support plate and said bar;

iv. concentrically positioning a toothed wheel about said rod and fixedly mated therewith such that said rod and said toothed wheel rotate in synchronization;

v. directly connecting an elbow lever to a center of said toothed wheel;

vi. directly mating a first end of an actuating arm to said elbow lever and extending outwardly therefrom in such a manner that said elbow lever is selectively rotatable about a fulcrum axis defined parallel to said rod; and vii. pivotally coupling a pawl to said elbow lever and spaced from said arm, said pawl being selectively interfitted within said a corrugated outer surface of said toothed wheel based upon a corresponding linear motion of said arm such that said plate and said seat section are pivoted about the fulcrum axis during operating conditions.

15. A method for allowing a fisherman to adjust a seating position during fishing operations on a water vessel while maintaining control over a fishing rod, said method comprising the steps of:

a. providing an elongated base member having axially opposed proximal and distal end portions;

b. connecting a bottom housing of a seat section to said base member;

c. linearly displacing said seat section along a longitudinal length of said base member such that said seat section is selectively positioned along a reciprocating path defined between said proximal and distal end portions of said base member;

d. adjustably pivoting said seat section along an arcuate path defined along a horizontal plane situated above said base member;

e. statically coupling a fishing rod holder to said seat section and extending outwardly therefrom along a path elevated above said base member;

f. providing a feet support member;

g. mounting said feet support member to said base member; and h. supporting user feet on said feet support member above said base member and at an elevated angle offset from the horizontal plane such that the user feet remain distally positioned in front of the user during operating conditions.

16. The method of claim 15, wherein step h. comprises the steps of:

i. providing a platform having a planar bottom portion and an arcuate upper portion monolithically formed therewith;

ii. anchoring a support stand to the distal end of said base member, said support stand being statically engaged with said base member;

iii. providing a finger extending downwardly from said platform, said finger being pivotally attached to a top end of said support stand such that said platform is freely articulated along an arcuate path distally spaced from said seat section; and iv. threadably mating a locking pin with said top end of said support stand and said finger respectively to thereby prohibit arcuate movement of said platform during operating conditions.

* * * * *